United States Patent [19]

Harpold et al.

[11] Patent Number: 4,817,523

[45] Date of Patent: Apr. 4, 1989

[54] FLAT BED SCREEN PRINTING PRESS

[75] Inventors: Charles W. Harpold; James E. Belcher, both of Grand Rapids, Mich.

[73] Assignee: Harco Graphic Products, Inc., Grand Rapids, Mich.

[21] Appl. No.: 921,606

[22] Filed: Oct. 20, 1986

[51] Int. Cl.[4] ..... B41F 15/08; B41F 15/42

[52] U.S. Cl. ..... 101/123

[58] Field of Search ..... 101/123, 126

[56] References Cited

U.S. PATENT DOCUMENTS

| | | | |
|---|---|---|---|
| 1,821,302 | 9/1931 | Gorner . | |
| 2,704,510 | 3/1955 | Walsh, Jr. . | |
| 2,793,586 | 5/1957 | Arelt | 101/123 |
| 2,894,451 | 7/1959 | Landesman . | |
| 2,975,705 | 3/1961 | Gilman . | |
| 3,166,011 | 1/1965 | Landesman . | |
| 3,263,603 | 8/1966 | Fuchs . | |
| 3,416,440 | 12/1968 | Miller et al. . | |
| 3,467,004 | 9/1969 | Best | 101/126 |
| 3,492,942 | 2/1970 | Forslund | 101/126 |
| 3,685,085 | 8/1972 | Jaffa . | |
| 3,731,623 | 5/1973 | Bubley et al. . | |
| 3,780,652 | 12/1973 | Black | 101/126 |
| 3,828,671 | 8/1974 | Fuchs . | |
| 3,859,917 | 1/1975 | Bubley et al. . | |
| 3,955,501 | 5/1976 | Bubley et al. . | |
| 4,254,708 | 3/1981 | Bubley et al. . | |
| 4,276,826 | 7/1981 | Bubley et al. | 101/126 |
| 4,389,936 | 6/1983 | Jaffa | 101/123 |
| 4,407,195 | 10/1983 | Jaffa | 101/123 |
| 4,413,559 | 11/1983 | Bubley . | |
| 4,537,126 | 8/1985 | Bubley . | |

FOREIGN PATENT DOCUMENTS

| | | | |
|---|---|---|---|
| 3207403 | 9/1983 | Fed. Rep. of Germany | 101/123 |
| 44348 | 3/1985 | Japan | 101/123 |

OTHER PUBLICATIONS

Advertising Brochure Entitled, "Original Svecia Print Master, SPM".

*Primary Examiner*—Clifford D. Crowder

*Attorney, Agent, or Firm*—Price, Heneveld, Cooper, DeWitt & Litton

[57] ABSTRACT

A screen printing press includes a main frame, a generally horizontal printing bed supported on the frame and a rectangular printing frame or head which is pivotal between a first, generally parallel printing position to a second, angled flood position. A squeegee and flood bar carriage is supported for reciprocating movement along the printing frame. The carriage includes a flood bar support member and a squeegee support member. The support members are engaged by a shifting plate which is pivoted to the carriage. A flipper rod assembly engages a sliding follower which is fixed to the shifting plate. The flipper bar assembly is pivoted to the printing frame. An actuating rod or tongue engages a shifting bracket fixed to the main frame of the press. Pivotal movement of the press alternately raises and lowers the flipper bar to alternately raise and lower the flood bar and squeegee support members.

10 Claims, 9 Drawing Sheets

FLAT BED SCREEN PRINTING PRESS

BACKGROUND OF THE INVENTION

The present invention relates to screen printing apparatus and more particularly to flat bed press screen printers.

In a typical screen printing operation, a silk or nylon screen is secured to a rectangular frame. The screen defines a picture, shape or the like to be printed with such defined area being permeable to the heavy printing ink. In printing, the screen is first flooded with the printing ink. A squeegee is then pressed into engagement with the screen and moved along the screen to force the ink through the permeable areas of the screen and onto a surface to be printed.

Automatic screen printing presses are presently available. Automatic presses generally include a main frame or base which supports a flat bed. Positioned above the bed is a printing frame or head. The printing frame is pivoted to the base adjacent its rear. A carriage is mounted on the printing frame for reciprocating movement. The carriage supports a flood bar and a squeegee. Screen clamps are provided on the frame for supporting the silk screen frame. In a typical device, the printing frame is pivoted upwardly away from a flat bed or table of the press. The flood bar is lowered into contact with the screen. The carriage is moved from the rear of the printing frame towards the front during a flood stroke. At the completion of the flood stroke, the printing frame is lowered and the screen is positioned above the stock held on the bed. The flood bar is moved away from the screen and a squeegee is moved into contact with the screen. The carriage is then moved backwardly from the front to the rear of the frame during a print stroke. The squeegee forces the ink through the screen and onto the stock.

Various devices have been included in such automatic flat bed presses for shifting the flood bar and the squeegee bar towards and away from the screen surface. These devices typically include fairly complicated linkage arrangements which are actuated upon raising and lowering of the print frame. It is important to proper operation of automatic screen printers that the positioning of the flood bar and squeegee be coordinated with the reciprocation carriage and the raising and lowering of the printing frame with respect to the bed.

SUMMARY OF THE INVENTION

In accordance with the present invention, a unique flat bed screen printing press is provided which automatically raises and lowers the flood bar and squeegee in coordination with pivotal movement of a printing frame or head. Essentially, the press includes a main frame or base which supports a table or bed. Provision is made for adjusting the table or bed with respect to the main frame. A printing frame is pivoted to the main frame. A squeegee and flood bar carriage is mounted on the printing frame for reciprocating movement. Provision is made for raising and lowering the printing frame with respect to the bed and for reciprocating the carriage along the frame during a flood stroke and a return print stroke. A flipper assembly is mounted on the printing frame. The flipper assembly includes an elongated actuating member which engages a slide block or follower. The follower is secured to a pivotal shift plate. The shift plate is pivoted to the carriage and engages a flood bar support member and a squeegee support member. Provision is made for raising and lowering the flipper automatically upon pivoting of the printing frame.

In narrower aspects, means are provided for reciprocating the carriage along the printing frame through a flood stroke and a print stroke. Further provision is made for raising and lowering the printing frame with respect to the table. A control system is provided for automatically coordinating the raising and lowering of the frame with the movement of the carriage.

DETAILED DESCRIPTION OF THE PREFERRED EMBODIMENT

Figure 1:
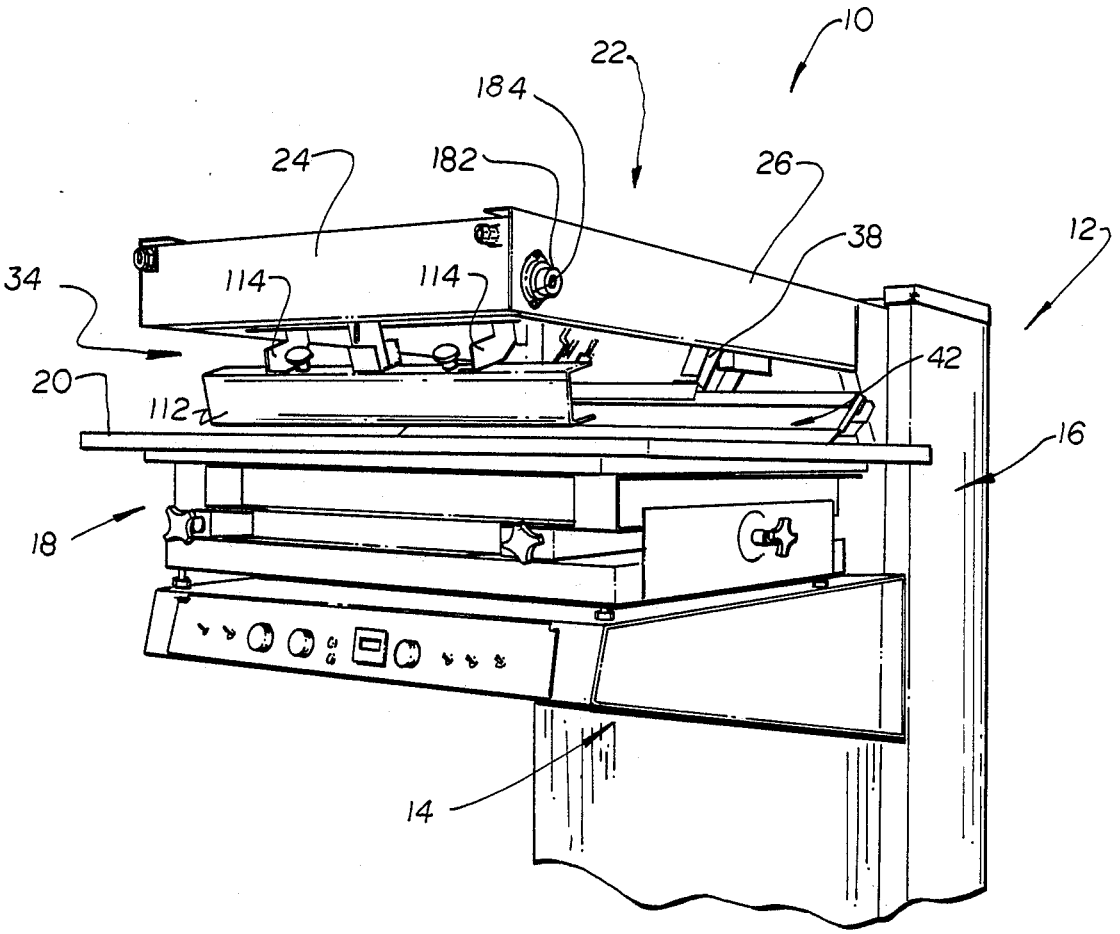
FIG. 1 is a perspective view of a flat bed printing press in accordance with the present invention.

A flat bed screen printing press in accordance with the present invention is illustrated in FIG. 1 and generally designated 10. Press 10 include a main frame or base 12. Base 12 includes a bed or table support frame 14 and uprights 16. Supported on bed frame 14 is a table or bed adjustment subassembly 18. Subassembly 18 supports a table or bed 20. In a conventional fashion, bed 20 is provided with a plurality of through apertures or holes. A source of vacuum (not shown) is applied to bed 20 to hold paper stock in position during the printing process.

Figure 2:
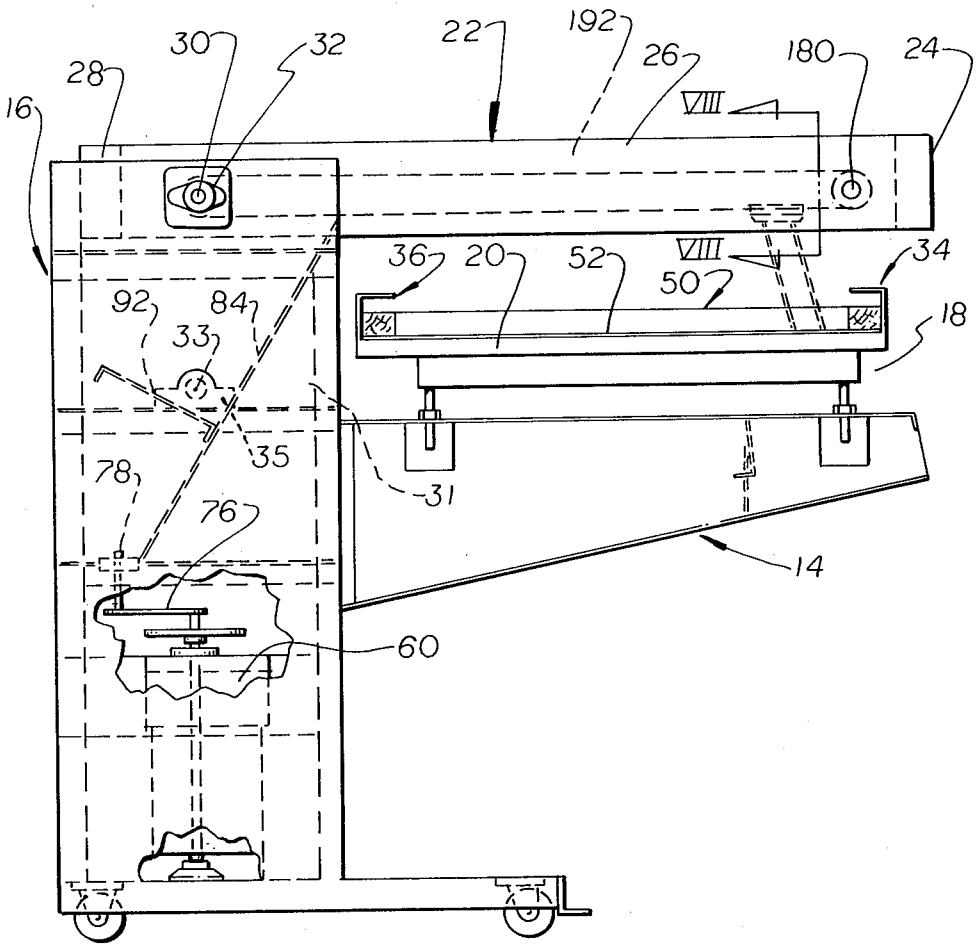
FIG. 2 is a fragmentary, side elevational view of the press main frame and printing frame.
Figure 11:
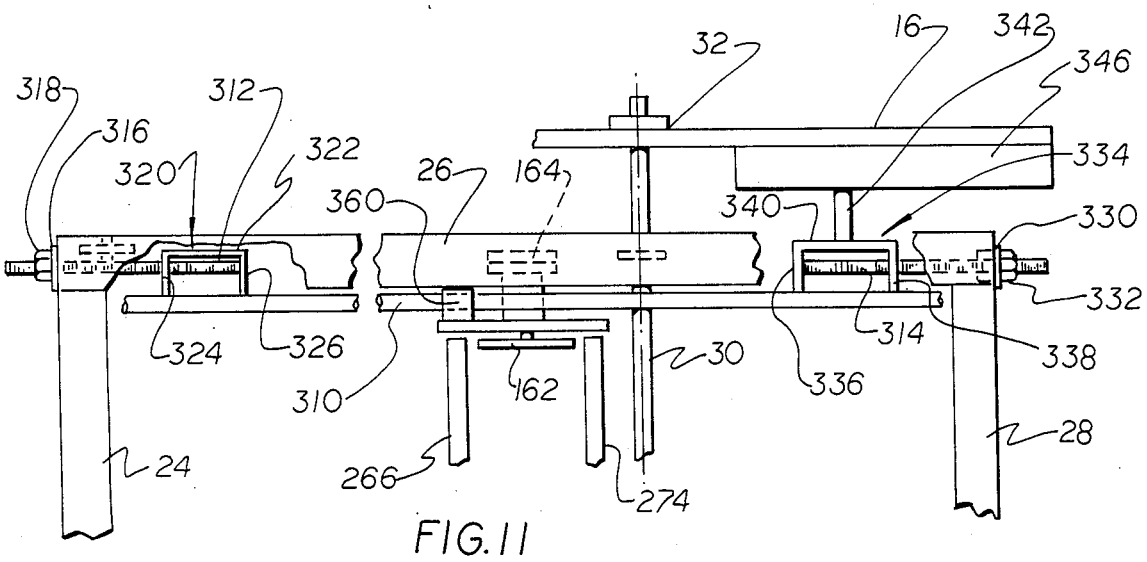
FIG. 11 is a fragmentary, top plan view schematically illustrating the squeegee flood bar actuating mechanism incorporated in the present invention.
Figure 10:
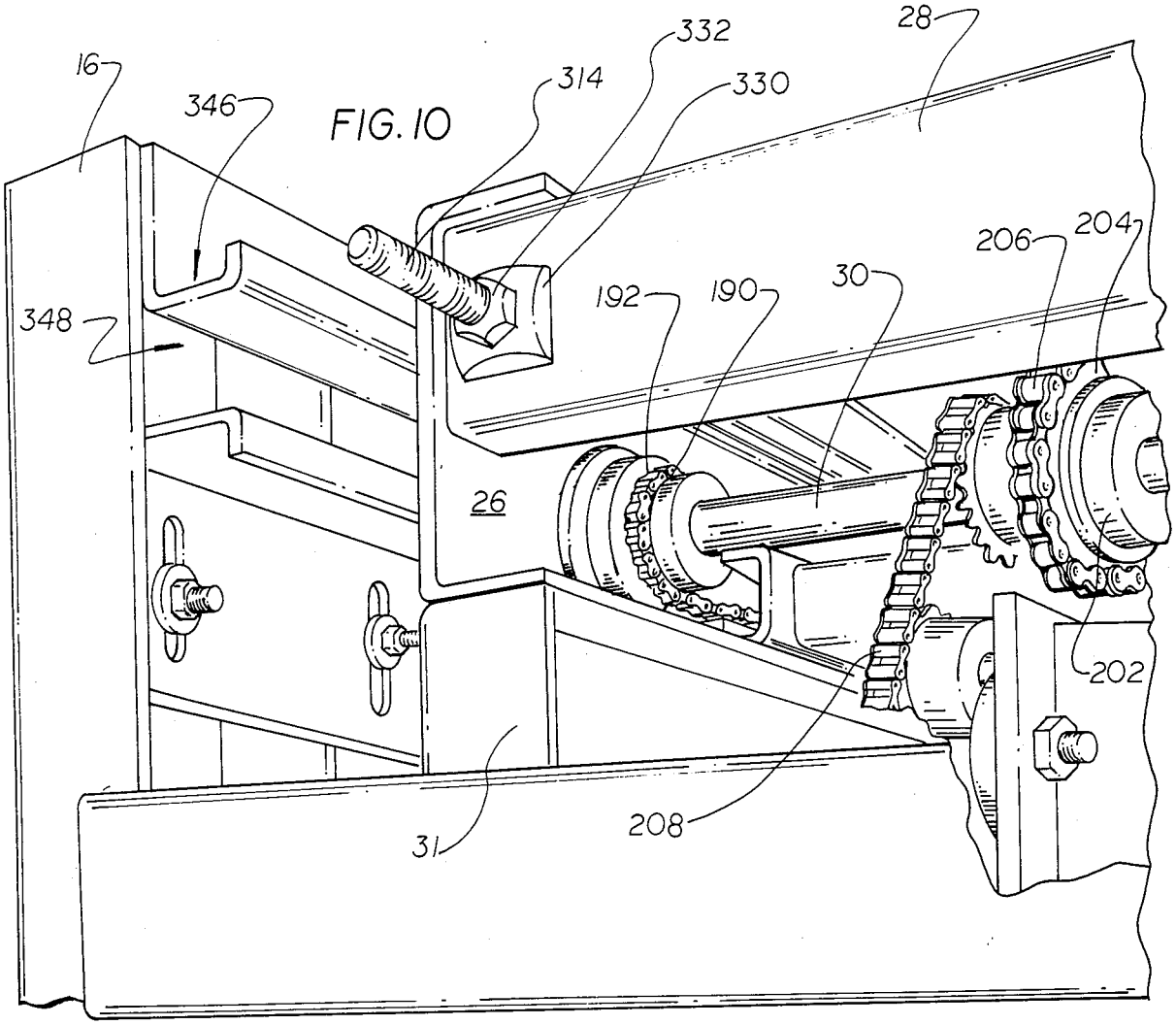
FIG. 10 is a fragmentary, rear perspective view showing a portion of the printing frame and a shifting bracket incorporated into the present invention.

Pivoted to uprights 16 of main frame 12 is a printing frame or head 22. Printing frame 22 is generally rectangular in shape and includes a front member 24, side members 26 and a rear member 28. As shown in FIGS. 2 and 11, printing frame 22 may be pivoted to uprights 16 of frame 12 by a carriage drive axle 30 Axle 30 extends through side members 26 of frame 22 and is supported on uprights 16 by bearing assemblies 32. In the alternative, as schematically shown in FIG. 2, frame 22 may include side plates 31 (FIG. 10). A pivot axle 33 supported by bearings 35 on uprights 16 may pivot the frame 22. In such an arrangement, bearings 32 would be mounted on side members 26 of frame 22.

Figure 4:
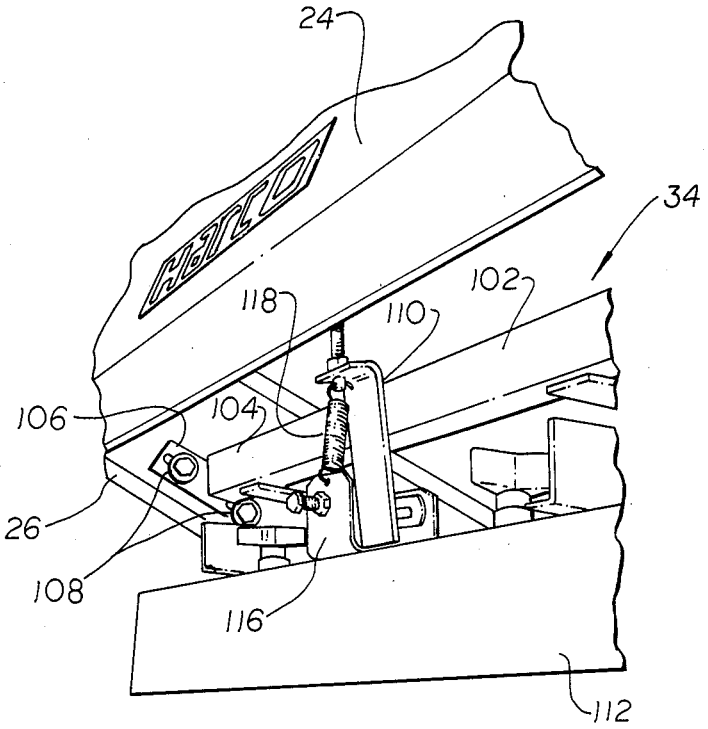
FIG. 4 is a fragmentary, perspective view showing the front screen clamp and off contact peeler mechanism incorporated in the present invention.
Figure 5:
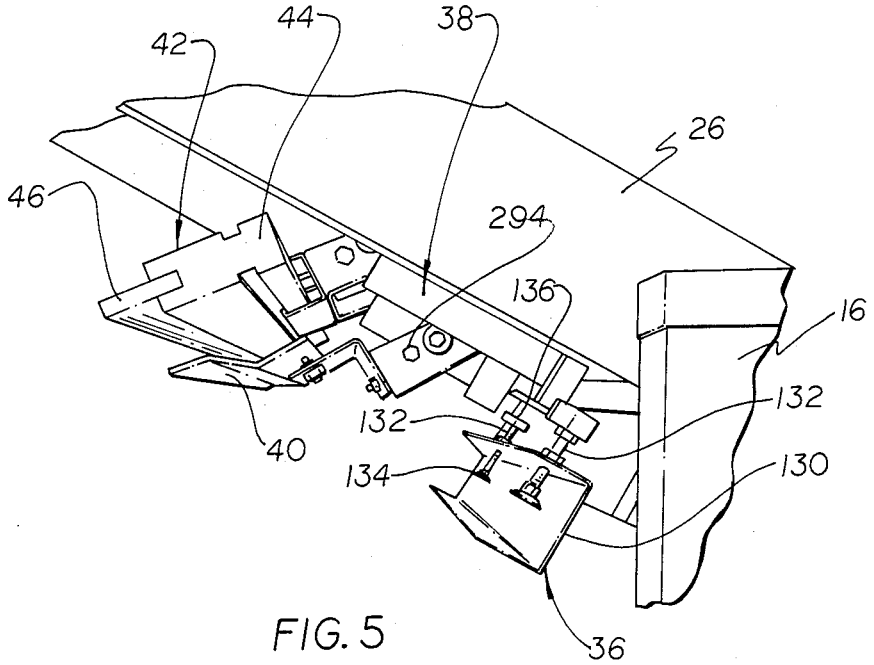
FIG. 5 is a fragmentary, side perspective view showing a portion of the printing frame, the squeegee and flood bar assembly and the rear screen clamp.

As shown in FIGS. 1, 4 and 5 and as schematically illustrated in FIG. 2, printing frame 22 supports a front screen clamp subassembly 34, a rear screen clamp subassembly 36 and a carriage subassembly 38. Carriage subassembly 38 in turn supports a flood bar 40 and a squeegee assembly 42. Squeegee assembly 42 includes an elongated squeegee block 44 to which a squeegee 46 is mounted. As schematically illustrated in FIG. 2, clamps 34, 36 hold a screen frame 50. Frame 50 carries a silk or nylon screen 52. When the printing frame 22 is in the lowered, horizontal position, frame 50 is positioned immediately over bed or table 20.

Printing Frame Drive

Figure 3:
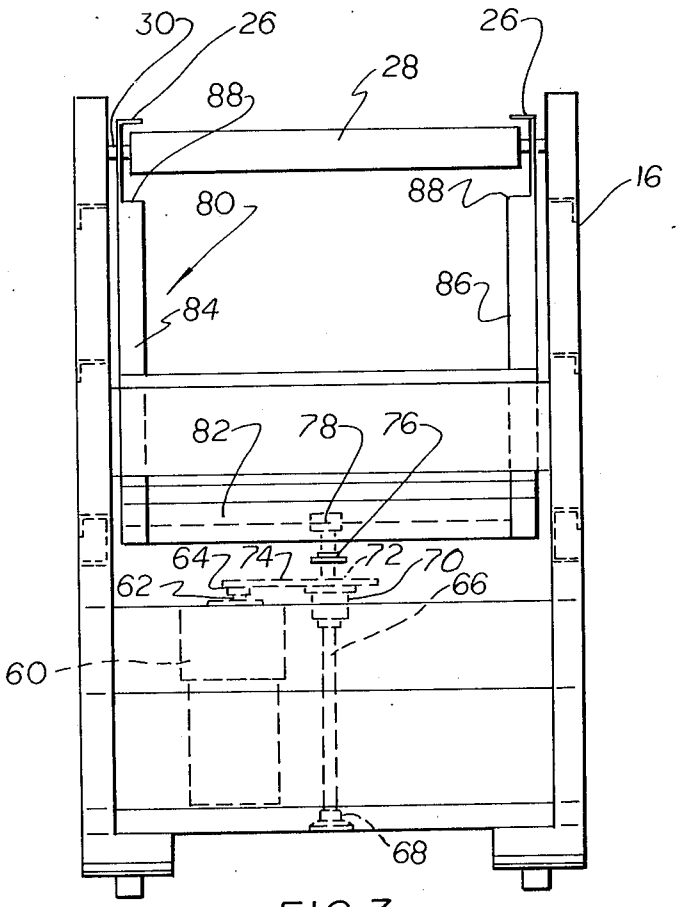
FIG. 3 is a rear elevational view of the press of FIG. 2.
Figure 6:
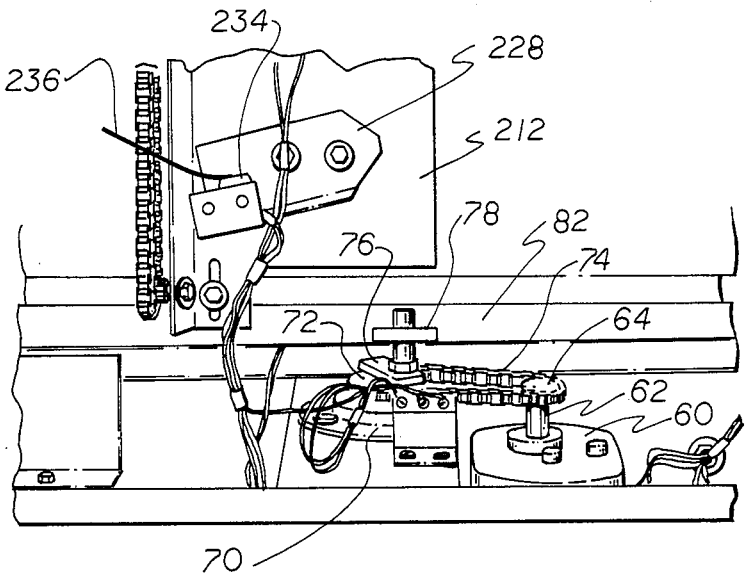
FIG. 6 is a fragmentary, rear perspective view of the press showing a portion of the crank drive and carriage control mechanism.

A printing frame drive for raising printing frame 22 from the printing position shown in FIG. 2 to an angled, flood position as partially shown in FIG. 5 is schematically illustrated in FIGS. 2 and 3. The drive includes a motor 60. Motor 60 includes an output shaft 62 which supports a sprocket 64. A crank shaft 66 is supported by a lower bearing assembly 68 and an upper bearing assembly 70. Fixed to shaft 66 is a sprocket 72. Sprockets 64, 72 are interconnected by a chain 74. As seen in FIGS. 2, 3 and 6, a crank arm 76 is fixed to shaft 66. Fixed to a free end of crank arm 76 is a cam 78. An arm assembly 80 includes a lower base 82 and side arms 84, 86. Upper ends 88 of arms 84, 86 are hinged to side members 26 of printing frame 22. Base 82 defines a wear plate or surface against which cam 78 rides. Base 82 is supported on frame 12 for horizontal movement. As crank arm 76 rotates through an angle of 180° from the position shown in FIG. 2, base 82 moves forward and arms 84, 86 move towards a vertical position. This action pivots printing frame 22 upwardly about axle 30. As shown in FIG. 2, a stop 92 is positioned to limit the rearward movement of arms 84, 86. Stop 92 positions printing frame 22 in a horizontal position with respect to bed or table 20.

Screen Frame Clamp Assemblies

The front screen frame clamp assembly 34 is illustrated in FIG. 4. Assembly 34 includes a support cross member or bar 102. Bar 102 has ends 104 secured to brackets 106. Brackets 106 are fastened to side members 26 by bolts 108. The front to back positioning of subassembly 34 is adjustable through bolts 108. Secured to cross member 102 is a clamp bracket 110. Suspended below bracket 110 is a front screen clamp 112. Clamp 112 is hingedly suspended from cross member 102 by hinge brackets 114 (FIG. 1). Secured to an upper surface of clamp 112 is an off contact peeler bracket 116. Peeler bracket 116 is connected to bracket 110 by a spring 118. As is known in the art, spring 118 raises clamp 112 away from bed 20 as the squeegee moves along screen 52 during the print stroke. This peeling action eliminates smearing of the ink on the print.

Rear screen clamp assembly 36 is adjustably positioned on printing frame 22 adjacent the rear thereof, as shown in FIG. 5. Rear assembly 36 includes a generally U-shaped clamp 130. Clamps 112 and 130 both support threaded shafts 132. Secured to the lower ends of shafts 132 are feet 134. Adjustment handles 136 are secured to the upper ends of shafts 132. Rotation of shafts 132 moves feet 134 into clamping engagement with frame 50.

Carriage Drive

Figure 8:
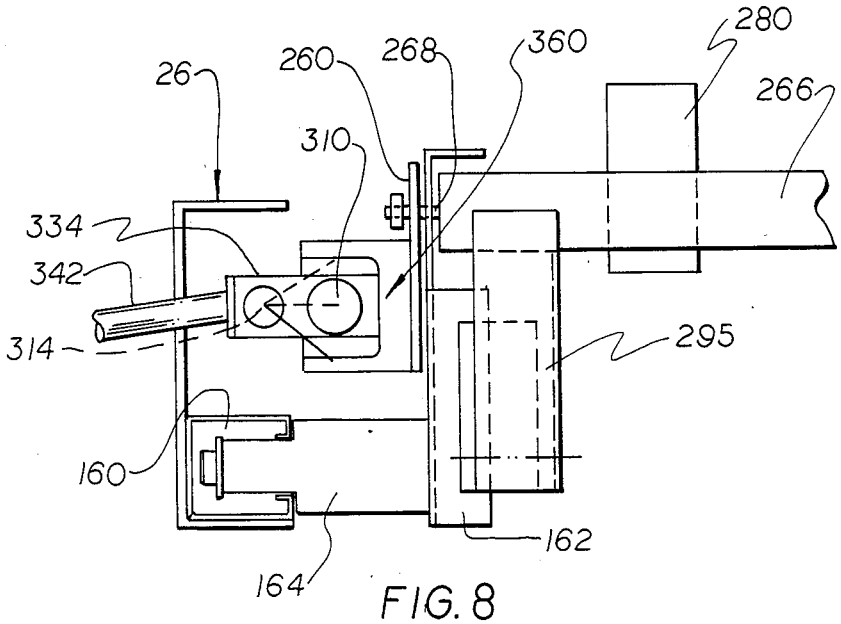
FIG. 8 is a fragmentary, cross-sectional view through a portion of the printing frame.

As shown in FIG. 8, each side member 26 of frame 22 supports an elongated, channel-shaped track 160. Track 160 extends substantially along the entire longitudinal length of members 26. Carriage subassembly 38 includes a pair of spaced carriage side plates 162. Plates 162 support outwardly extending slide blocks 164. Carriage plates 162 are supported on the side members 26 for longitudinal, reciprocating movement along track 160.

As seen in FIGS. 1 and 2, a front sprocket 180 is supported on a shaft 182 carried by a bearing 184. Secured within side members 26 at each end of rear shaft 30 are rear sprockets 190. A chain 192 extends around sprockets 180, 190. As schematically illustrated in FIG. 2, chain 192 is connected to slide block 164 extending from each carriage side plate 162. Rotation of sprocket 190, therefore, moves the carriage subassembly along the printing frame 22.

Figure 7:
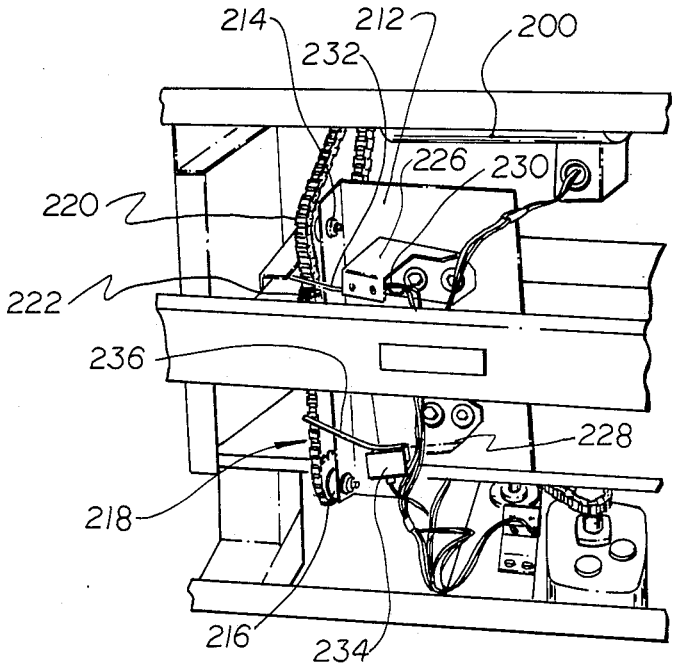
FIG. 7 is a fragmentary, rear perspective view showing the carriage control mechanism.

As seen in FIGS. 6, 7 and 10, a carriage drive motor 200 is supported on the press adjacent the rear thereof. Motor 200 includes an output shaft 202 which supports a sprocket 204. Sprocket 204 is connected to shaft 30 by a roller chain 206. Also mounted on output shaft 202 is a second sprocket 208.

As seen in FIGS. 6 and 7, supported at the rear of the press is a mounting plate 212. Positioned on mounting plate 212 in vertically spaced relationship are a pair of sprockets 214, 216. A roller chain 218 extends around motor driven sprocket 208 and sprockets 214, 216. Chain 218 defines a vertical run 220 between sprockets 214, 216. Secured to vertical run 220 is a stroke limiter or cam 222. Also mounted on plate 212 are upper and lower limit switch brackets 226, 228. Supported on bracket 226 is a limit switch 230 which has an actuating arm 232. Supported on bracket 228 is a second limit switch 234. Switch 234 has an actuating arm 236.

Figure 15:
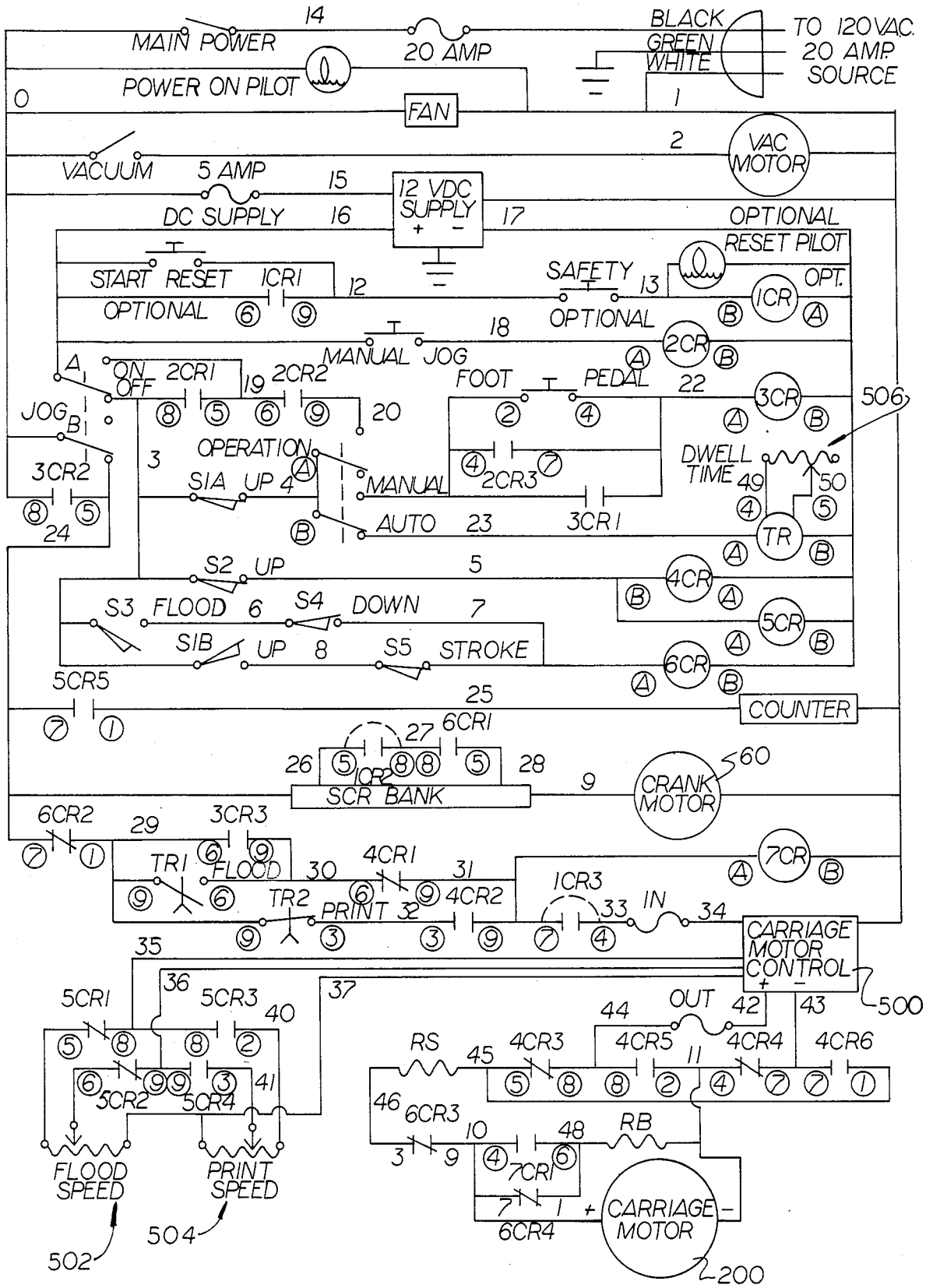
FIG. 15 is a schematic of the control system incorporated in the present invention.

As should be apparent from FIGS. 2, 7 and 10, as carriage drive motor 200 is actuated in a direction which moves the carriage subassembly 38 towards front member 24 during the flood stroke, vertical run 220 of chain 218 will move downwardly. At the point the limiter 222 contacts actuating arm 236 of limit switch 234, the carriage drive motor 200 is stopped. On the return print stroke, limiter 222 will move vertically towards arm 232 of limit switch 230. When it contacts arm 232, drive motor 200 is stopped. Suitable control circuitry, as shown in FIG. 15 and as discussed in more detail below, coordinates operation of motor 200 with press frame motor 60. Limit switches are included which are actuated by crank arm 76 to coordinate the operation of the carriage drive and the printing frame drive. The length of the flood/print strokes may be adjusted by vertical movement of limit switch brackets 226, 228 on support plate 212.

Squeegee/Flood Bar Actuator

Figure 9:
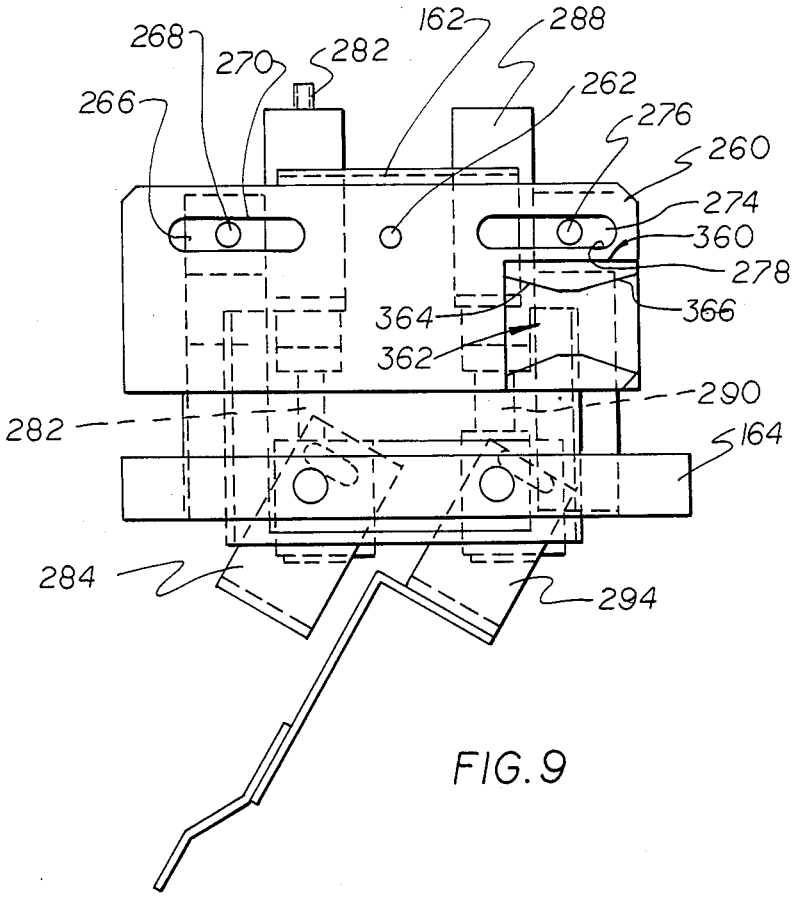
FIG. 9 is a partial, side elevational view of the carriage assembly.

As discussed above, the flood bar must move downwardly into contact with the screen during the flood stroke after frame 22 has been pivoted to its raised position. After the flood stroke, frame 22 is pivoted to its lowered, horizontal, printing position. When in this position, the flood bar must be raised and the squeegee lowered into contact with the screen. The apparatus for automatically accomplishing the shifting of the flood bar and squeegee is illustrated in FIGS. 8, 9 and 11. As shown therein, each carriage plate 162 has a pivot or shift plate 260 pivoted thereto. Plate 260 pivots about a central axis 262. A forward squeegee support cross member or bar 266 extends between plates 260. Bar 266 includes a stub shaft or axle 268 which rides within an elongated slot 270. Similarly, a flood bar support cross member or bar 274 extends between plates 260. Bar 274 includes a stub shaft or axle 276 which rides within an elongated slot 278.

As partially shown in FIGS. 8 and 9, squeegee support member 266 has fixed thereto a pair of spaced housings of blocks 280. A threaded shaft 282 is rotatably mounted within housings 280. Shaft 282 supports a squeegee mounting 284. Secured to flood shaft support member 274 are adjustment housings 288. A threaded shaft 290 supported by housings 288 extends down to and supports a flood bar bracket 294. Shafts 282, 290 permit vertical adjustment of the squeegee and flood bar with respect to the bed and screen frame. Such vertical adjustment is well known in the art. Such structure need not, therefore, be described in any greater detail. Also suspended from each support member 266, 274 are spaced guide brackets 295. Brackets 295 in a conventional fashion support squeegee bracket 284 and flood bar bracket 294 for vertical movement relative to carriage side plates 162. As should be readily apparent from FIG. 9, pivoting; of plate 260 in a clockwise direction will raise The squeegee subassembly and lower the flood bar subassembly. Pivoting of plate 260 in a counterclockwise direction, as viewed in FIG. 9, will lower the squeegee subassembly and raise the flood bar subassembly.

In accordance with the present invention, a unique flipper or actuator subassembly is provided for automatically raising and lowering the squeegee and flood bar subassemblies in coordination with the pivoting of the printing head frame.

As shown in FIGS. 10 and 11, elongated flipper bars 310 are supported in spaced, parallel relationship along and with side members 26. It should be understood that the flipper bars are provided at each side of the carriage subassembly to actuate a respective pivot or shift plate 260. Since the structures are identical, only a single subassembly is illustrated. Each rod 310 is supported on a side member 26 by pivot shafts 312, 314. Front pivot shaft 312 is received within a bushing 316. Threaded to shaft 312 is a cone nut 318. Cone nut 318 engages bushing 316 to rotatably support shaft 312. Shaft 312 is fixed to a U-shaped bracket 320. Bracket 320 includes a base 322 and spaced, parallel legs 324, 326. Legs 324, 326 are welded to rod 310. Similarly, rear shaft 314 extends through a bushing 330 on rear member 28. A cone nut 332 rotatably supports shaft 314 on bushing 330. A rear bracket 334 has legs 336, 338 welded to rod 310. In the preferred embodiment, bushings 316, 330 are molded from a urethane plastic material. The cone nuts 318, 332 center their respective shafts 312, 314 within bushing 330.

Extending perpendicularly to base 340 of bracket 334 is an actuating rod or tongue 342. Tongue 342 extends into a shifting bracket 346 which is secured to upright 16 of the main frame. As seen in FIG. 10, bracket 346 is channel-shaped in vertical cross section and defines an elongated slot 348. Actuating rod 342 rides within slot 348. A follower or slide block 360 is secured to pivot or shift plate 260 (FIGS. 8, 9, 11). Follower 360 defines a slot or passage 362. Slot 362 includes a converging forward portion 364 and a diverging rear portion 366. Follower 360 rides on and is engaged by actuating rod 310 (FIGS. 8 and 11).

As printing frame 22 pivots from a horizontal position to a raised, flood position, tongue 342 will move rearwardly within slot 348. The free end of tongue 342 will move upwardly to pivot shafts 314, 312. Rod 310 will, therefore, shift to a down position or flip position, as schematically shown in FIG. 8. Since follower 360 is engaged by rod 310, plate 260 will pivot in a clockwise direction, when viewed in FIG. 9. The squeegee subassembly will, therefore, be raised away from the screen and the flood bar will be moved downwardly into position for the flood stroke. Conversely, rotation of printing frame 22 from its raised position to its lowered, print position will pivot bar 310 about shafts 312, 314 as tongue 342 moves within bracket 346. Pivot plate 260 will then rotate in a counterclockwise direction, when viewed in FIG. 9, to lower the squeegee subassembly and raise the flood bar subassembly.

Table Adjustment Subassembly

Figure 12:
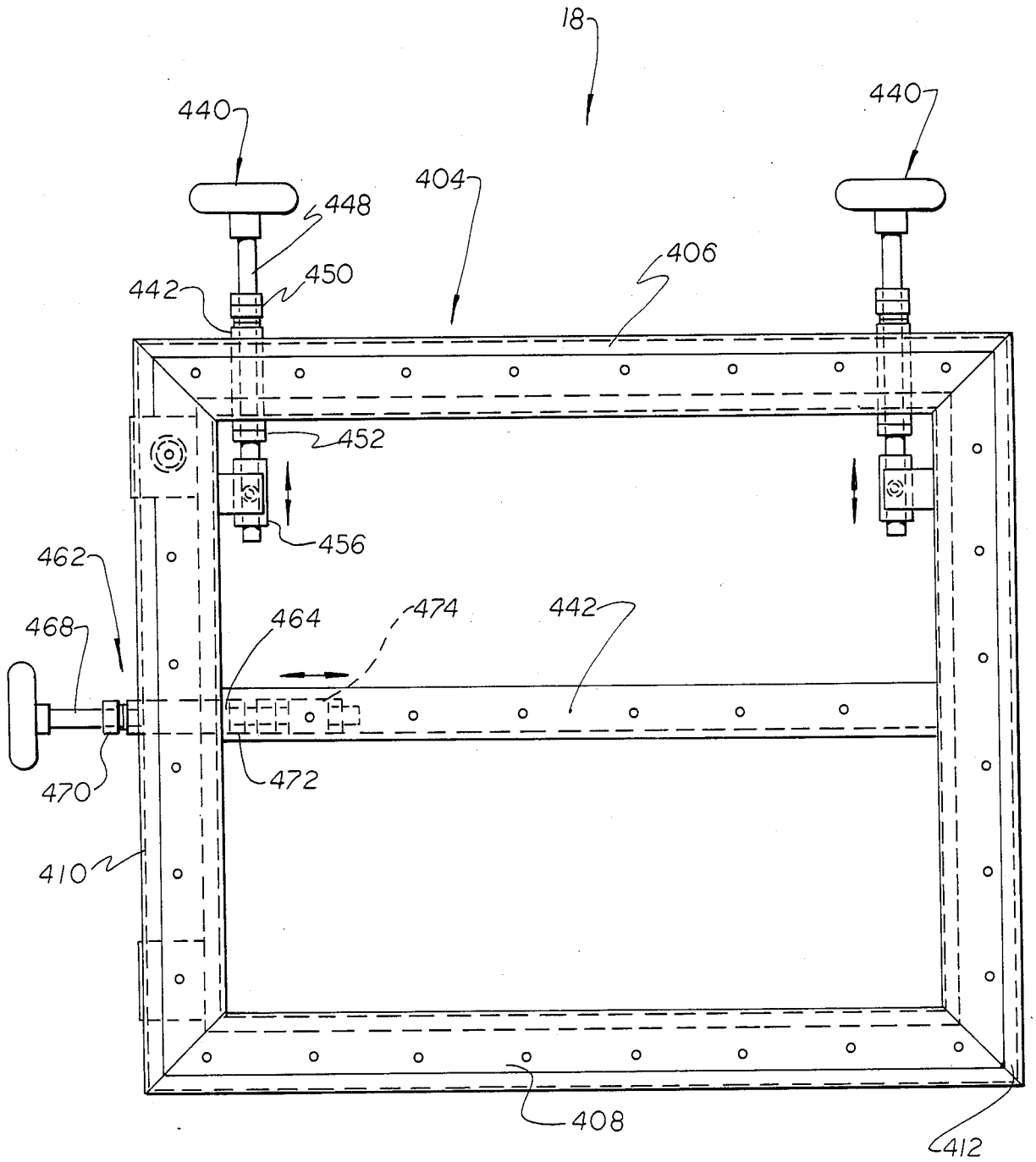
FIG. 12 is a top, plan view showing a bed adjustment mechanism incorporated in the present invention.
Figure 14:
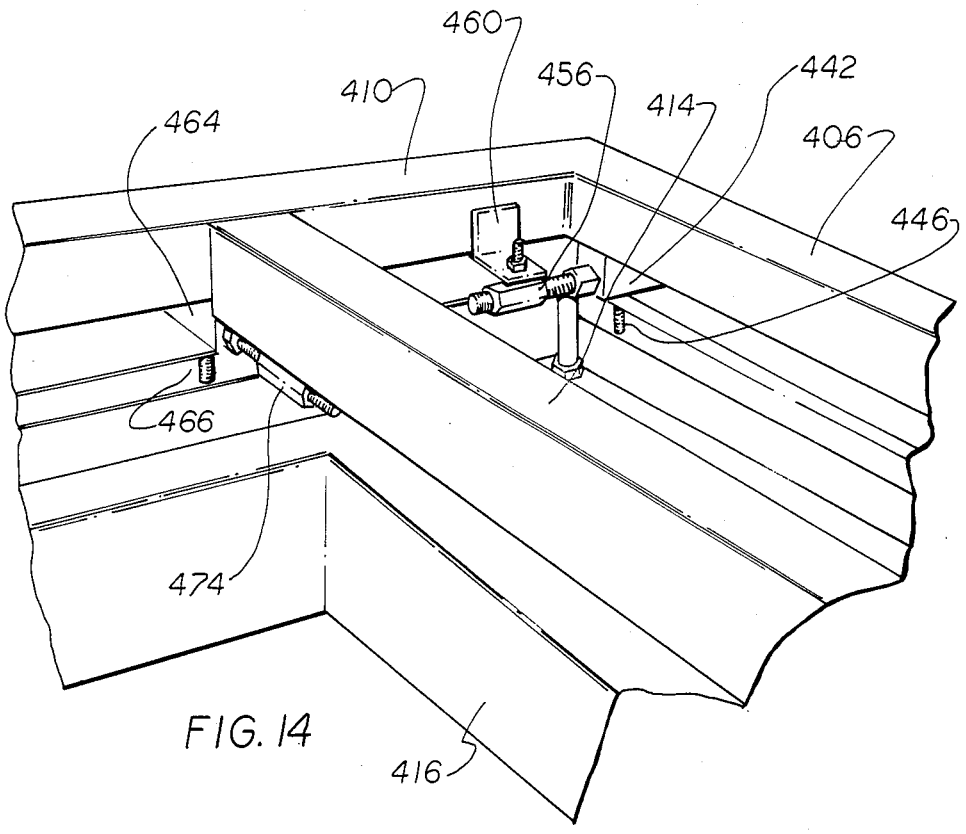
FIG. 14 is a fragmentary, top perspective view showing a portion of the mechanism of FIG. 12.
Figure 13:
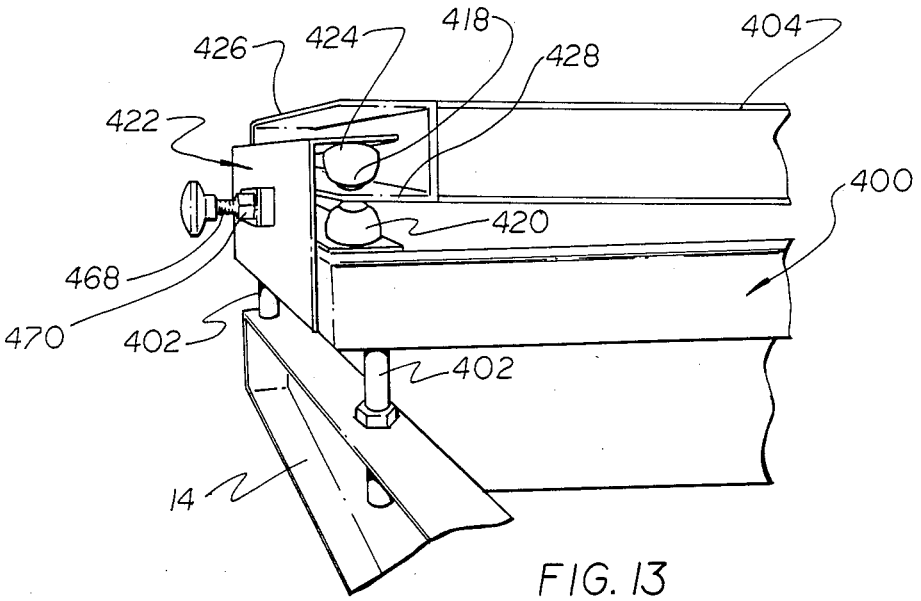
FIG. 13 is a rear, fragmentary, perspective view of a portion of the bed adjustment mechanism of FIG. 12.

Table adjustment subassembly 18 is illustrated in FIGS. 12, 13 and 14. A lower frame or base 400 is secured to frame portion 14. Base 400 includes front, rear and side members. Threaded shafts 402 adjustably position base 400 on frame 14. Up and down movement of threaded shafts 402 positions base 400 relative to frame 14. Positioned on top of base 400 is an upper frame or base 404. Upper base 404 includes a front member 406, a rear member 408 and side members 410, 412. Upper and lower frames 404, 400 also include transverse intermediate members 414, 416, respectively (FIG. 14). Upper base 404 is slidably mounted on lower base 400 by a plurality of roller casters 418, 420. Casters 418, 420 are positioned adjacent the corners of the bed adjustment assembly. As best seen in FIG. 13, a caster mounting plate 422 is secured at each side member of the lower frame. Casters 418 are mounted on the undersurface of an inwardly extending flange 424. Side members 410, 412 of the upper frame are generally channel-shaped in cross section including an upper flange 426 and a lower flange 428. Roller casters 420 are supported on the upper surfaces of the side members of the lower frame 400. Flange 428 of side members 410, 412 is positioned between roller casters 418, 420.

A pair of front adjustment subassemblies 440 are provided for front to back adjustment of base 404 with respect to lower base 400. Each adjustment assembly 440 includes a housing 442. Housing 442, as seen in FIG. 14, is pivoted to base 400 by a pivot shaft 446. A threaded adjustment shaft 448 extends through housing 442. Shaft 448 is supported on the housing by a pair of cone nuts or bearings 450, 452. Threaded to adjustment shaft 448 is a follower 456. Each follower 456 is pivoted to side members of the upper base frame by brackets 460.

A side to side adjustment means 462 is positioned intermediate the ends of a side member of the lower base 400. Adjustment means 462 similarly includes a housing 464 which is pivoted to the lower base 400 by a pivot shaft 466. A threaded adjustment shaft 468 is supported on housing 464 by cone nuts 470, 472. A follower 474 is threaded to shaft 468. Follower 474 is pivotally connected to intermediate member 442 of the upper base frame 404. Rotation of shafts 448 moves the upper frame in a front to back direction. Rotation of shaft 468 moves the upper frame in a side to side direction. The adjustment table structure permits the bed or table 20 which is secured to upper base 404 to be moved front to back, side to side and diagonally. Microadjustment of the table and the printing stock with respect to the screen frame is provided.

Electrical Controls and Operation

An electrical control system for the automatic printing press in accordance with the present invention is schematically illustrated in FIG. 15. The control system includes a carriage motor control 500, a flood speed potentiometer 502, a print speed potentiometer 504 and a dwell time potentiometer 506. Crank motor 60 is an AC motor, and carriage motor 200 is a DC motor. A flip-flop circuit in carriage motor control 500 controls the direction of rotation of these motors. The circuit is actuated by the limit switches discussed above contacted above the press crank and the carriage limit follower. Since the control system and the electrical circuitry involved are adequately illustrated in the schematic of FIG. 15, detailed description is not believed necessary.

In operation, with the carriage in position at the back of printing frame 22, crank motor 60 is actuated. Motor 60 rotates until frame 22 is in its raised position. At this point, a limit switch is tripped. This stops operation of motor 60. Tripping of the limit switch actuates the carriage motor 200 to move the carriage forward in the flood stroke. The speed of the motor during the flood stroke is controlled by the flood speed potentiometer 502. Rotation of printing frame 22 to its raised position has shifted the flood bar to its lowered, flood position and moved the squeegee subassembly out of contact with the screen. The carriage will move outwardly along printing frame 22 until limit switch 236 is tripped. This stops the carriage motor. The crank motor is then activated to lower the printing frame 22 to its print position. Lowering of the printing frame automatically raises the flood bar and lowers the squeegee subassembly into contact with the screen. When the crank motor reaches the lowered position, another limit switch is tripped. This reverses the direction of the carriage motor, activates the carriage motor and the carriage is returned on the print stroke. The speed of the carriage on the print stroke is controlled independently by the print speed potentiometer 504. At the completion of the print stroke, the cycle may be automatically repeated. The dwell time potentiometer 506 permits adjustment of a dwell time when the printing frame 22 is in its raised position to permit the print stock to be removed from the vacuum table 20 and another piece to be positioned thereon.

In view of the foregoing description, those of ordinary skill in the art will undoubtedly envision various modifications to the present invention which will not depart from the inventive concepts disclosed herein. Therefore, it is expressly intended that the above description should be considered as only that of the preferred embodiment. The true spirit and scope of the present invention may be determined by reference to the appended claims.

The embodiments of the invention in which an exclusive property or privilege is claimed are defined as follows:

1. A screen printing press comprising:

a main frame;

a printing bed supported on the main frame;

a rectangular printing frame having a rear end pivoted to said main frame for movement between a first printing position generally parallel to said printing table and a second flood position angled with respect to said printing table, said printing frame including elongated side members, a front member and a rear member, each of said side members defining an elongated track;

a squeegee and flood bar carriage engaging said elongated tracks and movable along said side members, said carriage including a pair of spaced side plates, a pair of slides, each slide extending from one of said side plates and into a respective one of said tracks, a pair of pivot plates, each pivot plate pivoted to one of said side plates, a squeegee support member extending between said pivot plates and a flood bar support member extending between said pivot plates in spaced, parallel relationship, said squeegee and flood bar support members being engaged by said pivot plates so that pivoting of said pivot plates alternately raises and lowers said squeegee and flood bar support members;

pivot plate actuating means operatively connected to said main frame and engaging at least one of said pivot plates for automatically lowering said flood bar support member when said printing frame is raised to its flood position and for automatically lowering said squeegee support member when said printing frame is in its printing position, said pivot plate actuating means including an elongated, rigid actuating member pivoted to said printing frame and operatively connected to said main frame, said elongated actuating member extending along and parallel to one of said side members of said printing frame;

a pivot bracket supporting said actuating member, said pivot bracket being pivoted to said printing frame;

shifting means fixed to said pivot bracket and operatively engaging said main frame for pivoting said pivot bracket as said printing frame moves between said first and said second positions; and means operatively connecting said actuating member to one of said pivot plates.

2. A screen printing press as defined by claim 1 wherein said shifting means comprises:

a channel-shaped shifting bracket fixed to said main frame adjacent the rear member of said printing frame; and a shifting tongue having an end fixed to said pivot bracket and extending generally perpendicular to said elongated actuating member, said shifting tongue having a free end extending into and engaging said shifting bracket.

3. A screen printing press as defined by claim 1 wherein said elongated actuating member is an elongated rod, said pivot bracket is generally U-shaped and includes a base and a pair of spaced legs and wherein said rod is joined to said legs and said shifting tongue is fixed to said base.

4. A screen printing press as defined by claim 1 wherein said means operatively connecting said actuating member to one of said pivot plates includes a slide block fixed to said pivot plate, said slide block riding on and being engaged by said actuating member.

5. A screen printing press as defined by claim 4 wherein said actuating member is a flipper bar and wherein said slide block defines a channel-shaped slot which receives said rod.

6. A screen printing press as defined by claim 5, wherein said channel-shaped slot of said slide block has a converging/diverging shape in longitudinal cross section.

7. A screen printing press as defined by claim 1 further including:

a printing bed adjustment means on said main frame and supporting said bed for permitting front to back, side to side and diagonal adjustment of said printing bed relative to said printing frame.

8. A screen printing press as defined by claim 7 wherein said bed adjustment means comprises:

a fixed, generally rectangular lower bed frame mounted on said main frame;

a movable, generally rectangular upper bed frame;

a plurality of rollers slidably mounting said upper bed frame on said lower bed frame;

a pair of front adjustment means engaging said upper bed frame for moving said upper bed in a front to back direction; and a side adjustment means engaging said upper bed frame for moving said upper bed in a side to side direction.

9. A screen printing press as defined by claim 8 wherein each of said front adjustment means comprises:

a bearing assembly pivoted to said lower bed an elongated, threaded shaft rotatably supported by said bearing assembly; and a follower threaded to said shaft, said follower being connected to said upper bed frame.

10. A screen printing press as defined by claim 9 wherein said side adjustment means comprises:

a bearing assembly pivoted to said lower bed frame;

an elongated, threaded shaft rotatably supported by said bearing assembly; and a follower threaded to said shaft, said follower being connected to said upper bed frame.

* * * * *

UNITED STATES PATENT AND TRADEMARK OFFICE

CERTIFICATE OF CORRECTION

PATENT NO. : 4,817,523

DATED : April 4, 1989

INVENTOR(S) : Charles W. Harpold, James E. Belcher

It is certified that error appears in the above-identified patent and that said Letters Patent is hereby corrected as shown below:

Column 2, Line 55:

"include" should be --includes--

Column 5, Line 14:

"of" should be --or--

Column 10, Claim 9, Line 9:

After "bed" insert --frame;--

Signed and Sealed this

Fifteenth Day of May, 1990

*Attest:*

HARRY F. MANBECK, JR.

*Attesting Officer*

*Commissioner of Patents and Trademarks*